US005165471A

United States Patent [19]

Atsumi

[11] Patent Number: 5,165,471

[45] Date of Patent: Nov. 24, 1992

[54] HEAT EXCHANGER FLUID REMOVAL SYSTEM

[75] Inventor: Schoichi Atsumi, Yamapo-Cho, Japan

[73] Assignee: American Screw Press, Inc., Oakland, N.J.

[21] Appl. No.: 769,464

[22] Filed: Oct. 1, 1991

[51] Int. Cl.[5] ..... F28D 11/02

[52] U.S. Cl. ..... 165/89; 34/125; 100/93 S

[58] Field of Search ..... 100/93 S, 145; 34/119, 34/124, 125; 165/89, 90

[56] References Cited

U.S. PATENT DOCUMENTS

| | | | |
|---|---|---|---|
| 267,666 | 11/1882 | Brigham | 34/125 |
| 1,108,077 | 8/1914 | Kilberry | 34/125 |
| 1,180,806 | 4/1916 | Vedder | 34/125 |
| 1,764,713 | 6/1930 | Broughton | 34/125 |
| 1,837,562 | 12/1931 | Mayer | 34/125 |
| 1,900,166 | 3/1933 | Dix | 165/89 |
| 2,661,546 | 12/1953 | Petry et al. | 34/124 |
| 2,678,600 | 5/1954 | Allen | 100/93 |
| 2,701,518 | 2/1955 | McDonald | 100/93 |
| 2,883,163 | 4/1959 | Solheim | 165/87 |
| 3,555,998 | 1/1971 | Meakin | 100/93 S |
| 3,800,865 | 4/1974 | Onarheim et al. | 165/92 |
| 3,939,763 | 2/1976 | Sato | 100/93 S |
| 4,254,561 | 3/1981 | Schiel | 34/124 |
| 4,856,580 | 8/1989 | Ley | 165/87 |
| 4,924,603 | 5/1990 | Wolf | 34/125 |

FOREIGN PATENT DOCUMENTS 1045802 12/1953 Fed. Rep. of Germany .

*Primary Examiner*—Allen J. Flanigan

*Attorney, Agent, or Firm*—Lerner, David, Littenberg, Krumholz & Mentlik

[57] ABSTRACT

This invention pertains to apparatus for removing heating or cooling fluid from a rotary heat exchange device comprising a hollow shell defining a shell chamber with an inner surface and an outer surface. The shell has first and second ends and a generally horizontal longitudinal axis extending between the ends. Thus, the shell defines axial directions along the axis, radial directions transverse to the axis and circumferential directions around the axis. The exchanger desirably also includes an inlet means for admitting a heat exchange fluid such as steam into the shell, and a shaft extending along the longitudinal axis, the shaft being at least partially hollow so as to define a shaft chamber. The apparatus also includes at least one set of collecting members, and typically involves several sets of such members. Each set of collecting members includes first and second radially-extensive and axially-extensive collecting members, mounted for rotation in unison with one another about the axis. The first collecting member extends radially inwardly from the inner surface of the shell, and the second collecting member is spaced apart from the first collecting member in a first circumferential direction so that the first and second collecting members of each set define a collection space therebetween. Each collection space communicates with the shell chamber at the second collecting member adjacent the interior surface of the shell.

20 Claims, 3 Drawing Sheets

HEAT EXCHANGER FLUID REMOVAL SYSTEM

BACKGROUND OF THE INVENTION

This invention pertains to apparatus and methods for removing heating or cooling fluid from a rotary heat exchange device. Particularly, it relates to an apparatus and methods for removing condensate from a steam heated screw press.

Many heat exchange devices such as drying drums or heated screw presses use internally injected steam to heat a rotating body, which in turn contacts the processed materials. In this process, the steam condenses within the apparatus, leaving condensate in the rotating body. This condensate must be removed in some fashion.

It is advantageous to minimize the amount of condensate present in a steam-heated screw press or drum. High efficiency in a heat exchanger may be attained only by minimizing the amount of condensate. It is desirable to remove only condensate from the heat exchange device and to prevent uncondensed steam from exiting the shell or drum. Escaping steam lowers the efficiency of the exchanger.

Moreover, the steam inlet and condensate outlet arrangements should not unduly complicate the construction of the apparatus, or cause other problems. For example, the rotating element of the apparatus normally must be driven by a shaft attached at one end of the element. It is therefore desirable to introduce steam and remove condensate at the other end. The steam circulation system, however, should assure that steam circulates throughout the axial extent of the rotating member, to both ends, and should remove condensate effectively from those portions remote from the steam inlet and outlet end.

Various arrangements have been proposed for accomplishing these tasks.

Sato, U.S. Pat. No. 3,939,763, discloses a rotating screw press with a tapered hollow shell and a condensate removal system. Steam flows from a steam inlet disposed at the small end of the screw drum, through a rotary coupling, and partially into the shaft. The steam vents out of the shaft and into the hollow shell. Cooled vapor is exhausted at the opposite end of the screw drum. The vapor enters into the shaft, flows out the drum, and is collected by a steam trap external to the drum. The shaft is substantially solid, particularly between the input and output heat exchange fluid conduits disposed at opposite ends of the shaft.

Solheim, U.S. Pat. No. 2,883,163, discloses a rotating heat exchanger having a hollow cylinder surrounded by hollow helical threads. The inside chamber of each thread is divided in half by a partition plate. Steam enters directly into the threads, heats the threads and surrounding material, and condenses. The condensate collects within the threads until the partition plate rotates into a substantially vertical position. Any condensate captured by the partition plate flows into the hollow cylinder via a stub pipe extending between the cylinder and threads. The condensate within the cylinder is evacuated by a siphon pipe.

Dix, U.S. Pat. No. 1,900,166 discloses vanes for discharging a liquid from a hollow drum or cylinder. Fins are disposed at the end of the drum closest to the condensate outlet. As the drum rotates, the fins guide the liquid from the circumference of the drum to an opening in the center of the end of the drum shell. This opening is directly connected to the condensate outlet. In other words, liquid is scooped from the bottom of the drum and flows directly into a discharge pipe.

Mayer, U.S. Pat. No. 1,837,562, also discloses vanes for discharging liquid from a hollow drum. The vanes scoop condensate from the bottom of the drum, and move the condensate towards an opening disposed in the center of the drum at the end opposite of the steam inlet. The condensate flows directly out a condensate outlet.

Despite this art, there is still need for further improvement.

SUMMARY OF THE INVENTION

The present invention addresses these needs.

One aspect of the present invention provides a heat exchange device comprising a hollow shell defining a shell chamber with an inner surface and an outer surface. The shell has first and second ends and a generally horizontal longitudinal axis extending between the ends. Thus, the shell defines axial directions along the axis, radial directions transverse to the axis and circumferential directions around the axis. The exchanger desirably also includes an inlet means for admitting a heat exchange fluid such as steam into the shell, and a shaft extending along the longitudinal axis, the shaft being at least partially hollow so as to define a shaft chamber.

The apparatus also includes at least one set of collecting members, and typically involves several sets of such members. Each set of collecting members includes first and second radially-extensive and axially-extensive collecting members, mounted for rotation in unison with one another about the axis. The first collecting member extends radially inwardly from the inner surface of the shell, and the second collecting member is spaced apart from the first collecting member in a first circumferential direction so that the first and second collecting members of each set define a collection space therebetween. Each collection space communicates with the shell chamber at the second collecting member adjacent the interior surface of the shell.

Rotation of the collecting members in the first circumferential direction causes liquid within the chamber to enter each collection space. The exchanger also comprises means defining a passageway extending generally radially inwardly from each collection space to the shaft chamber. Thus, liquid within each collection space will flow downwardly into the shaft chamber when that collection space is above the axis. Discharge means remove the liquid from the shaft chamber.

Desirably, the shell is mounted for rotation about the longitudinal axis, and the collecting members and shell are fixedly mounted within the shell for rotation therewith. Thus, upon rotation of the shell, liquid such as condensate within the shell is effectively removed. Preferably, the hollow shaft is also mounted for rotation about the longitudinal axis, and is fixedly connected to the shell for rotation with the shell and collecting plates.

The fluid removal system may also comprise means for preventing the flow of liquid from the hollow shaft to a collection space when the collection space is disposed below the axis. Preferably, this includes a tubular stand pipe projecting radially inwardly into the interior of the hollow shaft.

The first and second collecting members may be generally planar plates disposed in substantially radial planes and extending outwardly from the shaft towards the shell. Preferably, the first collecting plate extends between the shaft and inner surface of the hollow shell, and the second collecting plate extends outwardly from the shaft to an outer edge spaced radially inwardly from the inner surface of the shell, so that the outer edge of each second collecting plate and inner surface of the shell cooperatively define an opening.

The interior surface of the shell may be in the form of a surface of revolution about the axis, and may have a larger diameter at the first end than at the second end. In this arrangement, condensate within the shell will tend to collect adjacent the first or larger diameter end. The sets of collecting members desirably include a first group of one or more sets adjacent the first end of the shell. The shaft chamber may be an elongated axially-extensive bore extending from a blind end within the shaft towards an open end adjacent the second end of shell, and the discharge means desirably includes means for removing liquid via the open end of the bore. The fluid inlet means may include means for admitting a condensable heat exchange fluid such as steam to the chamber space adjacent the second end. Thus, the heat exchange fluid may be admitted, and the condensate may be removed, at the second end of the chamber. Preferably, the shell is driven in rotation by a motor or other suitable device connected to the shaft at the first end of the shell. Condensate forming within the shell and collection spaces adjacent the first end is collected by the first group of collecting plates, passed into the shaft chamber or bore, and conveyed back to the second end for removal. The fluid removal system may also comprise a wall extending from the shaft to the inner surface of the chamber between the first and second ends, the wall bounding each collection space. The wall may define a plurality of apertures adjacent the inner surface of the shell and spaced apart from one another about the circumference of the shell to permit axial flow of heat exchange fluid. The sets of collecting members may further include a second group of at least one set of such members disposed between the wall and the second end of the shell.

The fluid inlet means may include an input passageway extending coaxially within the shaft from the second end of the shell and communicating with the shell chamber, and a fluid inlet disposed external to the chamber and connected to the input passageway. Preferably, the input passageway communicates with the shaft chamber, and the discharge means comprises a siphoning conduit extending axially within the input conduit and extending into the shaft chamber. A siphon tip tube has one end connected to the siphon conduit and one other end extending downwardly within the shaft chamber, the siphon tip tube being fixed against rotation about the axis. With this arrangement, condensate collected within the shaft chamber or bore provides a seal against escape of steam.

The foregoing features of the invention are especially useful in screw presses. Thus, the shell may have a helical screw thread disposed on its outer surface and coaxial therewith, and the apparatus may include a generally tubular housing with two ends disposed generally coaxial with the shell such that it encloses the screw thread and shell. Intake means may be provided for introducing a material adjacent one end of the housing and between the housing and the shell for engagement with the thread, outlet means for discharging the material adjacent to other end of the housing, and drive means for rotating the shell. Preferably, the exterior surface of the shell is tapered.

These and other objects, features and advantages of the present invention will be more readily apparent from the detailed description and the preferred embodiments set forth below, taken in conjunction with the accompanying drawings.

DETAILED DESCRIPTION OF THE PREFERRED EMBODIMENTS

Figure 1:
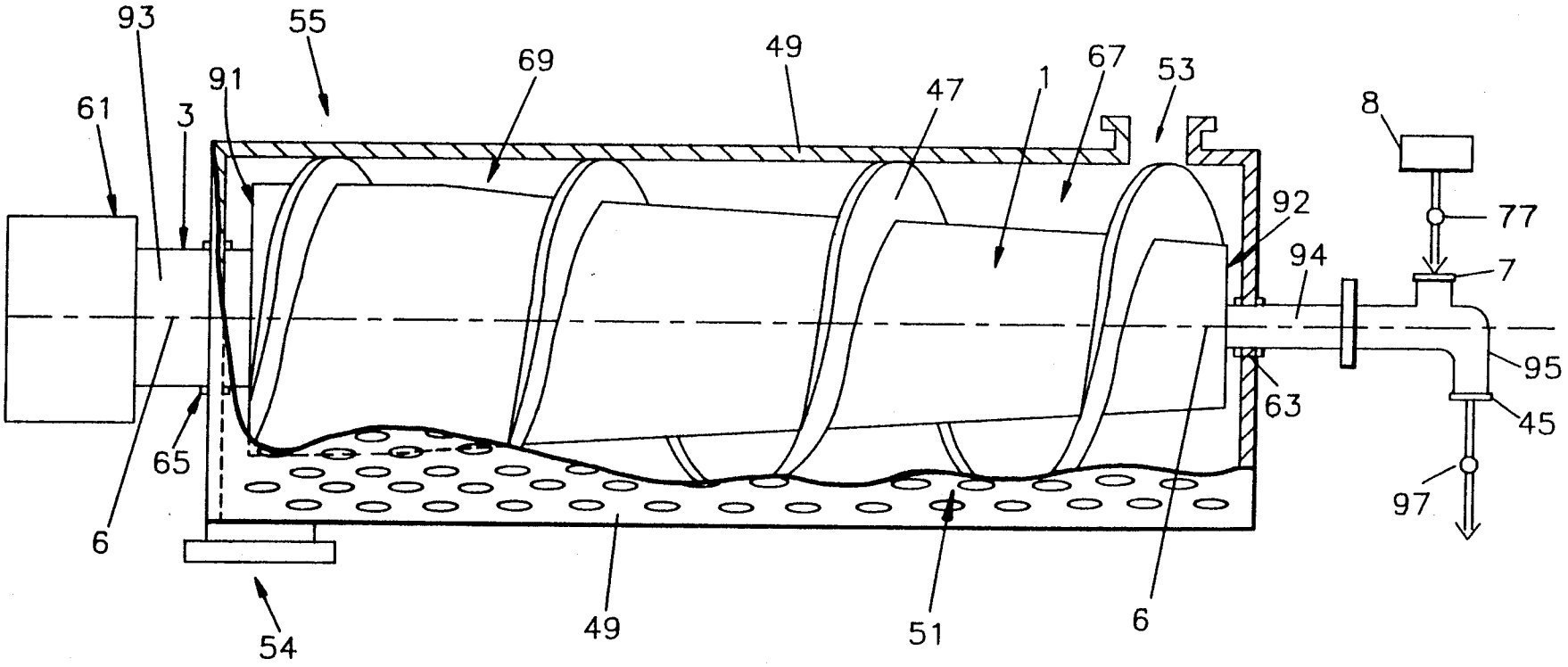
FIG. 1 is diagramatic partially sectional view of a screw press in accordance with one embodiment of the invention.

FIG. 1 depicts the general layout of a screw press in accordance with one embodiment of the invention. A tubular, generally cylindrical housing 49 having a perforated wall 51 is provided with an inlet port 53 at one end and an outlet port 54 at the opposite end. An elongated hollow screw shell 1 having a longitudinal axis 6 is disposed within housing 49 so that the longitudinal axis of the shell is coincident with the axis of the housing, the shell and housing cooperatively defining an annular space 67. Shell 1 has a first end 91 positioned adjacent outlet port 54 and a second end 92 positioned adjacent inlet port 53. Shell 1 has relatively large outside diameter adjacent first end 91 and a smaller outside diameter adjacent second end 92, so that the cross-sectional area of annular space 67 progressively decreases from inlet port 53 towards outlet port 54. A helical screw thread 47 is fixed to the exterior surface of shell 1 and extends generally coaxially with the shell within annular space 67. A shaft 3 is fixedly connected to shell 1 and extends through the shell along longitudinal axis 6. The shaft and shell are supported for rotation about axis 6 by bearings 63 and 65. Shaft 3 has a first end 93 and a second end 94 extending out of housing 49. The first end 93 of shaft 3, adjacent to the large first end 91 of shell 1, is connected to a rotary drive device 61 which may include a motor and gear train (not shown) arranged to rotate the shaft and shell in a preselected direction of rotation about axis 6.

In operation, material to be dewatered, such as wood pulp or sludge, is admitted to annular space 67 via inlet port 53 and advanced towards outlet port 54 by rotation of the shell and screw threads. As the material moves towards the outlet port, it is progressively compressed so that water or other liquid in the material is forced out through perforations 51 in the housing wall. The treated, solid material is discharged through outlet port 54. A steam inlet 7 and condensate outlet 45 are provided on a rotary connection body 95. Body 95 is fixedly and non-rotatably mounted outside of housing 49, adjacent the second end 94 of shaft 3.

As further discussed below, both steam inlet 7 and condensate outlet 45 communicate with the interior of shell 1 through shaft 3. Steam inlet 7 is connected through a steam inlet control valve 77 to a steam source 8, which may be a boiler, utility steam connection or the like. Condensate outlet 45 is connected through a discharge control valve 97 to a drain. In operation, steam from steam source 8 passes into shell and condenses, thereby heating the shell and the material in annular space 67. The resulting condensate is discharged through outlet 45. As further described below, the internal components of the shell and shaft assure circulation of the steam throughout the shell and removal of condensate from within the shell.

Figure 2:
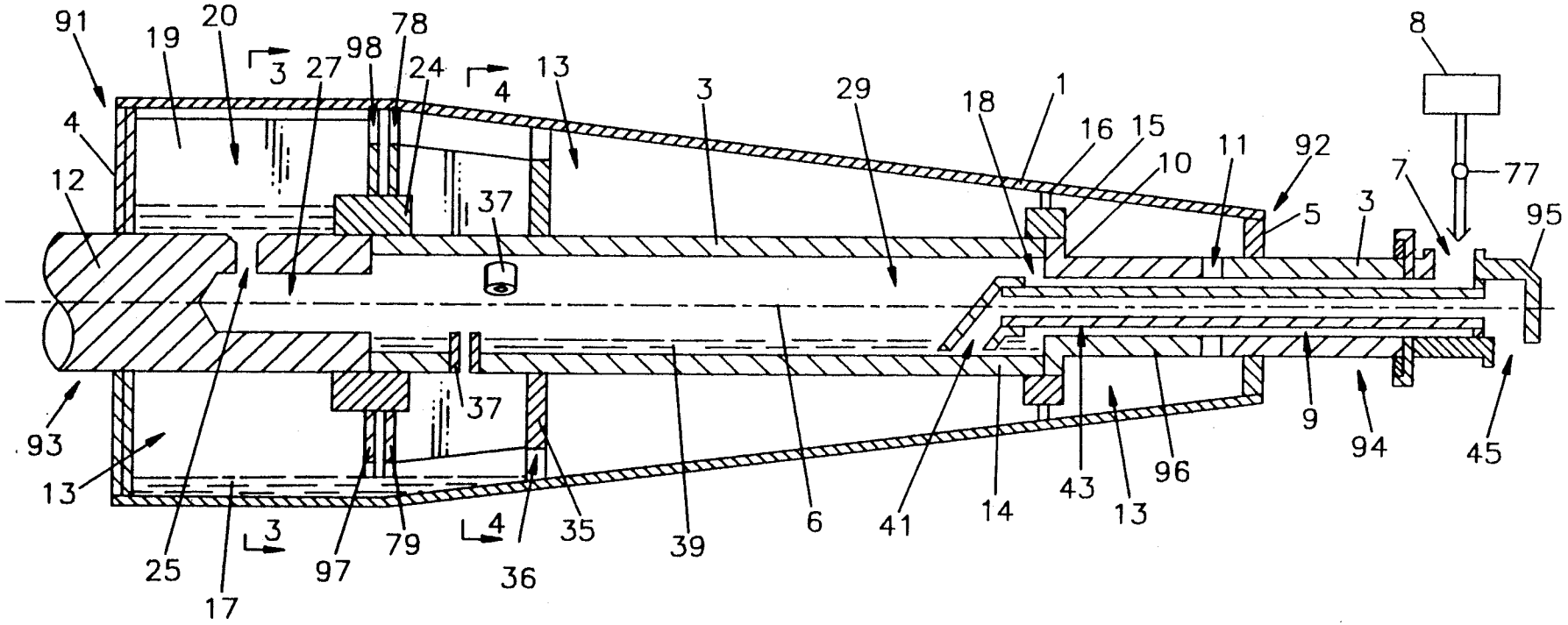
FIG. 2 is a fragmentary sectional view depicting certain components according to one embodiment of the present invention.
Figure 3:
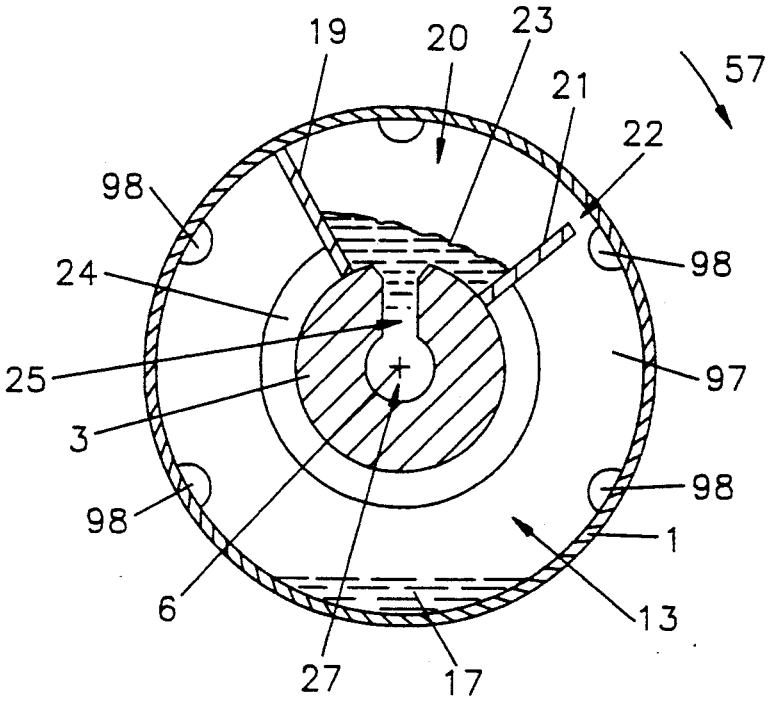
FIG. 3 is a sectional view taken along line 3—3 in FIG. 1.

As best seen in FIG. 2, shell 1 has a relatively thin circumferential wall generally in the form of a surface of revolution about longitudinal axis 6. Directions are stated in this disclosure with reference to the longitudinal axis 6. Thus, the terms "axial" and "axially" should be understood as referring to the directions parallel to the longitudinal axis, whereas the terms "radial" and "radially" should be understood as referring to the directions transverse to this axis. The term "radially inward" refers to directions towards the axis, whereas "radially outwardly" refers to directions away from the axis. "Circumferential" directions refer to directions around axis 6 such as the direction indicated by arrow 57 (FIG. 3).

The cylindrical portion of shell 1, adjacent the first end 91 of the shell, has constant inside and outside diameters. The conical portion of the shell extends from the cylindrical portion to the second end 92 and tapers inwardly so that its inside and outside diameters progressively decrease towards second end 92. Shell 1 is fixedly supported on shaft 3 by a pair of disc-like end plates or walls 4 and 5 at the first and second ends of the shell. End plates 4 and 5 seal the ends of shell 1, so that the shell and plates cooperatively enclose an inner chamber 13.

Shaft 3 is comprised of three cylindrical members 12, 14, and 96 which are fixedly connected to each other in end-to-end relation by flange joints 24 and 15. A portion of member 12 extends outside of shell 1, and forms the first end 93 of the shaft. This portion of member 12 is substantially solid. Another portion of large member 12 disposed within chamber 13, has a short, blind-ended axial bore 27. Member 14 is a pipe disposed entirely within chamber 13, and has an interior bore 29 communicating with bore 27 of member 12, so that bores 27 and 29 cooperatively constitute an axially extensive shaft chamber surrounding axis 6, the shaft chamber having a blind end disposed adjacent the first end 91 of the shell and an open end 18 disposed adjacent the second end 92 of the shell. Bore 29, adjacent the open end 18 of the shaft chamber, has a substantially longer inside diameter than bore 27, adjacent the blind end of the shaft chamber. A funnel-shaped passageway 25 extends generally radially in member 12, from the exterior surface of the shaft to bore 27.

Figure 4:
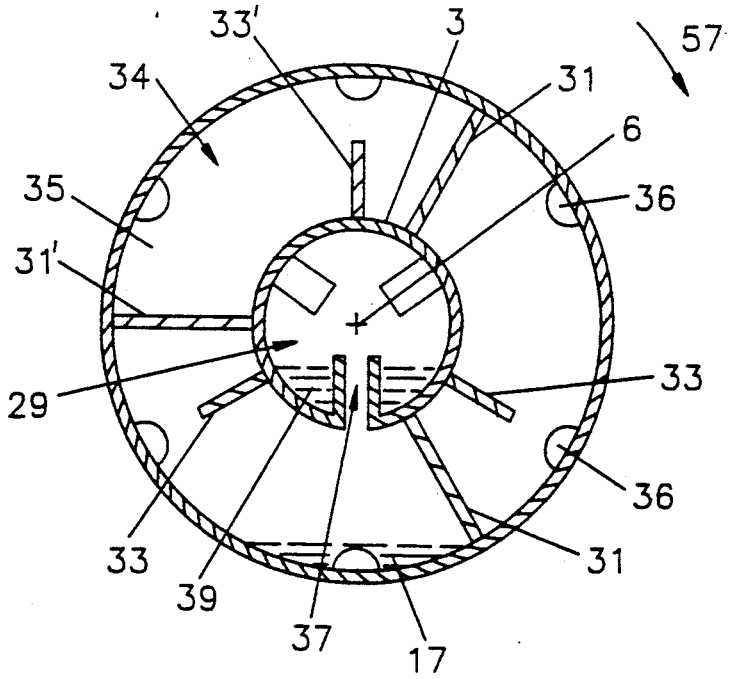
FIG. 4 is a sectional view taken along line 4—4 in FIG. 1.

Three tubular funnels or stand pipes 37 extend through the wall of member 14, from the outer surface of such member 14 into bore 29. The distance between longitudinal axis 6 and the radially innermost ends of the funnels 37 extending into bore 29 is smaller than the distance between longitudinal axis 6 and the inner surface of member 14. In other words, the distance from axis 6 to the innermost ends of funnels 37 is less than the radius of bore 29. The three funnels 37 are spaced apart from one another in the axial direction. As best seen in FIG. 4, the three funnels are spaced circumferentially at equal, 120 degree intervals about axis 6.

The rest of shaft 3 is comprised of hollow, tubular cylindrical member 96, which lies along longitudinal axis 6 and defines the second end 94 of the shaft. Member 96 is fixedly connected to member 14 at joint 10. The outside diameter of member 96 is less than the outside diameter of member 14. Member 96 defines an axially extensive steam conduit or bore 9, which opens into bore 29 at the open end 18 of the shaft chamber, and extends to the second end 94 of shaft 3. A plurality of bores 11 extend radially through the wall of member 96 at a location within chamber 13 but adjacent the second end 92 of the shell, so that steam conduit or bore 9 communicates with chamber 13 via bores 11. Steam conduit 9 has an inside diameter less than that of bore 29.

At the second end of shaft 3, member 96 is rotatably connected to coupling body 95 by conventional rotatable sealing elements (not shown) so that steam conduit or bore 9 communicates with steam inlet 7. The sealing elements with body 95 may be any standard rotary coupling elements which allow fluid to pass into the bore 9 of shaft member 96 from the stationary steam inlet 7 while the shaft rotates. Coaxially disposed within steam conduit 9 is siphon pipe 43. Siphon pipe 43 is mounted to shaft member 96 for rotation therewith. Siphon pipe 43 is connected to coupling body 95 by rotatable seals (not shown) so that the interior of the siphon pipe communicates with condensate outlet 45, but not with steam inlet 7. Steam inlet 7 and condensate outlet 45 are isolated from one another.

Siphon pipe 43 protrudes axially into bore 29. A tubular siphon tip 41 is mounted to the end of siphon pipe 43 disposed within bore 29. Siphon tip 41 protrudes radially outwardly from siphon pipe 43 so that the radially outermost end of the siphon tip is disposed just slightly inwardly of the wall of bore 29. The siphon tip is rotatable with respect to pipe 43 about axis 6. Accordingly, siphon tip 41 will remain substantially in the position illustrated in FIG. 2, and will continue to point downwardly within bore 29, despite rotation of siphon pipe 43. The tubular siphon tip communicates with the interior of siphon pipe 43.

A generally flat, disc-like wall 97 extends radially outwardly from flange joint 24 of shaft 3 to the cylindrical portion of shell 1 adjacent its juncture with the coaxial portion. Wall 97 extends circumferentially around shaft 3. As best seen in FIG. 3, wall 97 has openings 98 at its juncture with the interior surface of shell these openings being circumferentially spaced apart from one another. A similar wall 79, having similar openings 78 extends from flange joint 24 to the conical portion of shell 1. A further, similar wall 35 having circumferentially spaced openings 36 (FIG. 4) extends from exterior of shaft member 14 to the conical portion of shell 1, whereas yet another wall 16 extends between flange joint 15 and the shell. Wall 16 also has openings at its juncture with the shell.

Disposed within chamber 13 adjacent first end 91 of the shell are flat, generally planar first and second collecting plates 19 and 21, seen in FIGS. 2 and 3. Collecting plates 19 and 21 extend axially from end plate 4 to wall 97 and joint 24. As shown in FIG. 3, the first or "long" collecting plate 19 extends radially from an inner edge fixed to the outer surface of shaft 3 to an outer edge fixed to the inner surface of shell 1.

The second or "short" collecting plate 21 extends radially outwardly from shaft 3, but does not reach the inner surface of shell 1. The inner edge of short collecting plate 21 is mounted to the outer surface of shaft 3, and the outer edge of the collecting plate is disposed at a spaced radial distance from the inner surface of shell 1, so that the short plate and shell cooperatively define an opening 22 therebetween. Short collecting plate 21 is also spaced forwardly of long collecting plate 19 in a first circumferential direction as designated by arrow 57. (The clockwise direction as seen in FIG. 3) This direction corresponds to the direction of rotation of the shaft and shell in service. Stated another way, short plate 21 is spaced forwardly of long plate 19 in the direction of rotation of the apparatus. The circumferential distance between the intersection of the plates with shaft 3 can be stated as the angle with the vertex of the angle at axis 6. Preferably, short collecting plate 21 is about 90° forward of long collecting plate 19 and shaft 3, in the circumferential direction 57. However, this circumferential spacing between the long and short plates should not be more than about 120.. The spaced collecting plates 19 and 21, in cooperation with wall 4, wall 97 and shaft 3 define collection space 20 communicating with interior space 13 of the shell via opening 22. Passage 25 opens into space 20, and thus connects collecting space 20 with bore 27.

Another group of collecting plates extend axially between walls 79 and 35. As seen in FIG. 4, this group of collecting plates incorporates three sets of plates, each including a first or long plate 31 and a second or short plate 33. Long collecting plates 31 are radially extensive, with one edge fixed to the outer surface of shaft 3 and the other edge fixed to the inner surface of shell 1. Short collecting plates 33 are also radially extensive, and have one end fixed to the outer surface of shaft 3. However, like short collecting plate 21, each short collecting plates 33 ends at a spaced radial distance from the inner surface of shell 1.

Each short collecting plate 33 is spaced forwardly of the corresponding long collecting plate 31 in the first circumferential direction 57. For example, short collecting plate 33' is 90° forward of long collecting plate 31'. Each set of plates 31 and 33, cooperatively with shaft 3 and walls 79 and 35, defines a wedge-shaped collection space 34. Each such collection space communicates with the surrounding portion of shell chamber 13 at the opening between the short plate 33 and shell 1. Here again, the circumferential spacing between the intersection of the plates 31 and 33 of each set with shaft 3 can be varied, but should be less than about 120°. Also, long and short collecting plates 31 and 33 are arranged in alternating sequence in the circumferential direction 57, around the outer surface of shaft 3, so that collection spaces 34 are disposed at equal, 120° intervals about axis 6.

Each funnel 37 has an opening between each short collecting plate 33 and its corresponding long collecting plate 31. Thus, each collection space 34 communicates with bore 29 of the shaft, via one funnel 37.

In a process of deliquifying material, material to be treated is fed through input port 53 and into annular space 67 as rotary drive device 61 rotates the shaft 3, shell 1 and screw threads 47 in direction 57. The material is forced axially through annular space 67 and compressed therein. As the material is compressed, liquid is squeezed out of the material and flows through perforations 51 of the housing. The treated, solid material passes out of housing 49 via discharge opening 54.

During this process, steam from steam source 8 enters steam inlet 7 and flows through rotary coupling body 95 and into steam conduit 9. Much of the incoming steam passes outwardly through bores 11 into shell chamber 13 adjacent the second end thereof. The rest of the steam in conduit 9 travels further down shaft 3 and into shaft chamber or bore 29. This steam also enters chamber 13 by flowing outwardly through funnels 37. Steam within chamber 13 flows axially through the chamber by passing through holes 16, 36, 78 and 98 of walls 15, 35, 79 and 97, respectively. The steam heats shell 1 and the screw threads.

As the steam heats shell 1, it condenses, and forms a pool of condensate 17 at the bottom of shell 1. Because the inside diameter of shell 1 is longer adjacent the first end 91 of the shell, the inner surface of the shell is lower adjacent the first end. The pooled condensate therefore collects adjacent the first end of the shell.

The pooled condensate 17 is removed from chamber 13 by the two groups of collecting plates. As seen in FIG. 3, collecting plates 19 and 21 rotate along with shell and shaft 3 in the circumferential direction of rotation 57. Because short collecting plate 21 does not reach shell it passes over and rotates by the condensate 17. Stated another way, the pooled condensate enters collection space 20 through opening 22 when the collection space is momentarily brought to the bottom of the device by rotation of the shaft and shell. Long collecting plate 19, on the other hand, blocks passage of the condensate 17 at the point of intersection between collecting plate 19 and shell 1. As collecting plate 19 rotates, it delivers the condensate 17 towards the top of shell 1. When plates 19 and 21 and collection space 20 are brought to the position shown in FIG. 3, the condensate forms a pool 23 in space 20 above passageway 25. The condensate is momentarily held in place by collecting plates 19 and 21, ring 24, wall 97 and end plate 4. This condensate 23 then flows downwardly into passageway 25 and into bore 27. The condensate flows axially along bore 27 and drains quickly into bore 29 FIG. 2). No appreciable accumulation of condensate occurs in blind bore 27. Thus, when continued rotation brings passageway 25 to below axis 6, there will be no substantial back flow from bore 27 to the collection space.

The second group of collecting plates 31 and 33 also remove the condensate 17 disposed at the bottom of shell 1, as seen in FIG. 4. As shaft 3 and shell 1 rotate in the circumferential direction of rotation 57, each short collecting plate 33 passes over condensate 17, and its corresponding long collecting plate 31 collects the condensate and delivers it towards the top of the shell. Thus the condensate enters each collection space 34 when that chamber is momentarily at the bottom, beneath axis 6. When a collection space 34 is above axis 6, the condensate forms a pool over the opening of the associated funnel 37, and the condensate drains downwardly through such funnel into the bore or shaft chamber 29. Because the inside diameter of steam conduit 9 is less than the inside diameter of bore 29, condensate does not flow axially into the steam conduit at opening 18, but instead accumulates as a pool 39 within bore 29.

The condensate 39 present in shaft chamber 29 is removed through siphon tip 41 and siphon pipe 43. Because of the relatively small diameter of shaft 3 as compared to shell 1, the condensate 39 is sufficiently deep to allow siphon tip 41 to remain continuously immersed in the condensate. Thus, no steam will be evacuated with the condensate. The pressure of the steam within shaft chamber 29 pushes the condensate up through siphon pipe 43 and out condensate outlet 45. Because siphon tip 41 is continuously immersed in the condensate 39, condensate is discharged continuously instead once or a few times per rotation. This continuous removal of condensate allows continuous stable flow of steam into the screw shell.

The funnels or standpipes 37 prevent backflow of condensate from bore 29 into collection spaces 34 and shell chamber 13. As each such funnel or standpipe is brought to below axis 6 by rotation of the apparatus, the radially innermost end of the standpipe protrudes above the pooled condensate 39 in bore 29.

The apparatus described above can be readily fabricated from conventional materials. The particular materials used will depend upon the material to be processed. The apparatus is simple, rugged and easy to maintain. In particular, the ability to use a solid shaft portion at the drive or first end, while also employing a hollow shaft in the remainder of the apparatus, provides for a rugged connection between the drive means and the shell. The collecting plates reinforce the shell. Because the rotary coupling 95 is disposed at the end of the apparatus remote from the drive, it is readily accessible for maintenance.

As will be readily appreciated, numerous variations of the features discussed above may be used. Thus, more or fewer collecting plates can be used. For example, a single group of collecting plates may extend throughout the entire axial length of the shell. Also, the collecting members need not be planar plate-like elements, but may be curved bodies. Also, the collecting members need not extend precisely parallel to the axis. Instead, the collecting members need only be axially extensive, meaning that each member has two ends spaced apart from one another in the axial direction. Likewise, the collecting members do not necessarily have to extend exactly in the radial direction. However, the construction described above, in which collecting members are planar plates allows easy and inexpensive construction.

Although the preferred embodiment shows the condensate removal system within a screw press, the system may also be used in any rotating heat exchanger, particularly cylindrical drums.

As these and other variations and combinations of the features described above can be utilized without departing from the present invention as defined in the appended claims, the foregoing description of the preferred embodiment should be understood as being illustrated rather than as limiting the invention as defined in the claims.

I claim:

1. Heat exchange apparatus comprising:

(a) a hollow shell defining a shell chamber, said shell having an inner surface and an outer surface, said shell having first and second ends and a generally horizontal longitudinal axis extending between said ends, whereby said shell defines axial directions along said axis, radial directions traversed to said axis and circumferential directions around said axis;

(b) inlet means for admitting a heat exchange fluid to said shell chamber;

(c) a shaft extending along said longitudinal axis, said shaft being at least partially hollow and defining a shaft chamber adjacent said axis;

(d) at least one set of collecting members disposed with said shell chamber, said or each set of collecting members including first and second radially-extensive and axially-extensive collecting members, said rotatable collecting members being mounted for rotation in unison with one another about said axis, said or each first collecting member extending radially inwardly from said inner surface of said shell, said second collecting member of said or each set being spaced apart from the first collecting member of such set in a first circumferential direction so that the first and second collecting members of said or each set define a collection space therebetween, said or each collection space communicating with said shell chamber adjacent to said inner surface of said shell, whereby upon rotation of said collecting members in said first circumferential direction, liquid within said chamber will enter or each said collection space;

(e) means defining a radially-extensive passageway from said or each collection space to said shaft chamber, whereby liquid within said or each collection space will flow downwardly into said shaft chamber when such collection space is above said axis; and (f) discharge means for removing liquid from said shaft chamber.

2. Apparatus as defined in claim 1 wherein said shell is mounted for rotation about said longitudinal axis and wherein said collecting members are fixedly mounted within said shell for rotation therewith.

3. Apparatus as defined in claim 2 wherein said shaft is mounted for rotation about said longitudinal axis and fixedly connected to said shell for rotation with said shell and said collecting members.

4. Apparatus as claimed in claim 3 further comprising backflow prevention means for preventing flow of liquid from said shaft chamber to said or each collection space when such collection space is disposed below said axis.

5. Apparatus as claimed in claim 4 wherein said backflow prevention means includes a tubular standpipe associated with said or each collection space, said or each standpipe having an outer end communicating with one said collection space, and an inner end communicating with said shaft chamber, said inner end of said or each stand pipe projecting radially inwardly into said shaft chamber.

6. Apparatus as claimed in claim 3 wherein each of said members is a generally planar plate disposed in a substantially radial plane and extending outwardly form said shaft towards said shell.

7. Apparatus as claimed in claim 6 wherein said or each first collecting plate extends between said shaft and said inner surface of said hollow shell, said or each second collecting plate extending outwardly from said shaft to an outer edge spaced radially inwardly from said inner surface of said shell so that said or each outer edge and said inner surface of said shell define an opening.

8. Apparatus as claimed in claim 7 wherein the radial distance between the outer edge of said or each second collecting member and the outer surface of said shaft is between about 60% to 85% of the radial distance between said inner surface of said shell and the outer surface of said shaft.

9. Apparatus as claimed in claim 6 wherein said radial planes of said first and second collecting plates of said or each set are spaced apart from one another about 45° to about 120° in said circumferential direction.

10. Apparatus as claimed in claim 3 wherein said at last one set of collecting members includes a first group of one or more said sets, said collecting members of said first group extending axially adjacent to said first end of said shell.

11. Apparatus as claimed in claim 10 wherein said inner surface of said shell is in the form of a surface of revolution about said axis and has a larger diameter at said first end than at said second end, said fluid inlet means including means for admitting a condensable fluid to said shell chamber adjacent said second end.

12. Apparatus as claimed in claim 11 further comprising a wall extending from said shaft to said inner surface of said shell between said first and second ends, said collecting members of said first group axially extending from said first end of said shell to said wall, said wall bounding said or each collection space defined by said collecting members of said first group.

13. Apparatus as claimed in claim 12 wherein said wall defines a plurality of apertures adjacent said inner surface of said shell and spaced apart from one another in said circumferential direction.

14. Apparatus as claimed in claim 12 wherein said at last one set of collecting members further includes a second group of at least one said set disposed between said wall and said second end of said shell.

15. Apparatus as claimed in claim 14 wherein said shaft chamber of said shell includes an elongated axially-extensive bore extending from a blind end towards an open end adjacent said second end of shell.

16. Apparatus as defined in claim 15 wherein said bore of said shaft has a first section adjacent said blind end and a second section adjacent said open end, the diameter of said second section being larger than the diameter of said first section, said discharge means including means for removing liquid from said second section.

17. Apparatus as defined in claim 3 wherein said fluid inlet means includes an input passageway extending coaxially within said shaft from said second end of said shell and communicating with said shell chamber, and a fluid input disposed external to said chamber and connected to said input passageway.

18. Apparatus as defined in claim 17 wherein said input passageway communicates with said shaft chamber, said discharge means comprising a siphoning conduit extending axially within said input conduit and extending into said shaft chamber, and a siphon tip tube having one end connected to said siphon conduit and one other end extending downwardly within said shaft chamber.

19. Apparatus as defined in claim 3 further comprising a helical screw thread disposed on said outer surface of said shell and coaxial therewith, a generally tubular housing with two ends, said housing being generally coaxial with said shell, said housing enclosing said screw thread and said shell, intake means for introducing a material adjacent one end of said housing, and between said housing and said shell for engagement with said thread, outlet means for discharging said material adjacent to other end of said housing, and motor means for rotating said shell.

20. Apparatus as defined in claim 19 wherein said exterior surface of shell is tapered.

* * * * *

UNITED STATES PATENT AND TRADEMARK OFFICE

CERTIFICATE OF CORRECTION

PATENT NO. : 5,165,471

DATED : November 24, 1992

INVENTOR(S) : Schoichi Atsumi

It is certified that error appears in the above-identified patent and that said Letters Patent is hereby corrected as shown below:

Column 5, line 2,"shell and" should read --shell 1 and--.
Column 6, line 45, "shell" should read --shell 1--.
Column 7, line 16, "120.." should read --120°.--.
Column 8, line 17, "shell and" should read --shell 1 and--.
Column 8, line 19, "shell it" should read --shell 1 it--.
Column 8, line 36, "FIG.2)" should read --(Fig. 2)--.
Column 10, line 44, "form" should read --from--.
Column 10, line 65, "last" should read --least--.
Column 11, line 19, "last" should read --least--.

Signed and Sealed this

Nineteenth Day of October, 1993

Bruce Lehman

*Attest:*

BRUCE LEHMAN

*Attesting Officer*

*Commissioner of Patents and Trademarks*